US005769011A

United States Patent [19]

Daniel

[11] Patent Number: 5,769,011

[45] Date of Patent: Jun. 23, 1998

4

[54] TRANSACTION SECURITY SYSTEM

[76] Inventor: Robert R. Daniel, P.O. Box 16555, Colorado Springs, Colo. 80935

[21] Appl. No.: 731,140

[22] Filed: Oct. 10, 1996

[51] Int. Cl.[6] ..... E05G 5/00

[52] U.S. Cl. ..... 109/7; 52/79.1; 52/143; 49/68; 340/825.31; 109/2

[58] Field of Search ..... 107/2, 3, 5–7, 107/10–13; 340/825.31; 49/68; 902/30, 31, 33, 35; 52/79.1, 143; 70/278

[56] References Cited

U.S. PATENT DOCUMENTS

| | | | |
|---|---|---|---|
| 2,874,819 | 2/1959 | Nutter | 49/68 |
| 3,564,132 | 2/1971 | Baker | 340/825.31 |
| 3,669,038 | 6/1972 | Watson | 109/12 |
| 3,993,006 | 11/1976 | Murphy et al. | 340/825.31 |
| 4,121,523 | 10/1978 | Hastings . | |
| 4,237,799 | 12/1980 | Berman . | |
| 4,308,803 | 1/1982 | Pretini . | |
| 4,348,966 | 9/1982 | Hastings . | |
| 4,475,465 | 10/1984 | Hastings . | |
| 4,481,887 | 11/1984 | Urbano | 109/3 |
| 4,741,275 | 5/1988 | Lewiner et al. | 70/278 |
| 4,773,338 | 9/1988 | Hastings . | |
| 5,311,166 | 5/1994 | Frye . | |
| 5,400,722 | 3/1995 | Moses et al. . | |

FOREIGN PATENT DOCUMENTS

| | | | |
|---|---|---|---|
| 0171369 | 2/1986 | European Pat. Off. | 109/2 |
| 0599291 | 6/1994 | European Pat. Off. | 109/2 |
| 3233843 | 1/1984 | Germany | 109/2 |
| 2044327 | 10/1980 | United Kingdom | 49/68 |

*Primary Examiner*—Darnell M. Boucher
*Attorney, Agent, or Firm*—Richard W. Hanes

[57] ABSTRACT

A transaction security system is disclosed which provides protection and security for transaction customers while conducting their business, such as those visiting a remote bank automatic teller machine. The enclosure can accommodate either or both vehicular and pedestrian traffic. A system of detectors and operators open the appropriate door for ingress of an authorized customer and maintain the doors to the facility closed and locked while the customer is transacting business. When the customer exits the facility, door opening mechanisms are again enabled to offer admittance and service to the next authorized customer.

4 Claims, 2 Drawing Sheets

TRANSACTION SECURITY SYSTEM

The present invention relates to a security system and more particularly to a transaction enclosure for both vehicular and pedestrian traffic.

BACKGROUND

The use of automated bank teller machines poses security risks to bank customers immediately before, during and after a transaction. It is therefore the primary object of the present invention to provide a secure enclosure for the conduct of transactions where valuable items are deposited or received by a customer.

Another object of the invention is to provide such an enclosure for both vehicular and pedestrian traffic.

Transaction modules, as such, are not new, but the simplicity of such prior art devices is compromised by the fact that most of such systems are primarily concerned with protection of bank tellers or other bank employees and not the banking customers. Exemplary of these kinds of devices are those disclosed in the Otis Hastings patents, U.S. Pat. Nos. 4,121,523, 4,348,966, 4,475,465 and 4,773,338. These patents disclose a cylindrical module into which a person is admitted and in which there is a transaction screen between the admitted person and the bank teller until such time as the module door is closed. The admitted person cannot exit the module until released by the bank personnel. A protective door system is disclosed in U.S. Pat. No. 4,308,803 to Pretini which allows bank control of persons entering the bank. A partition system to segregate a vestibule, having an automated teller machine therein, from the rest of the bank premises is disclosed in U.S. Pat. No. 4,237,799. An intruder's presence in a banking vestibule can be detected by the device shown in U.S. Pat. No. 5,311,166. A security module of a more elaborate type is disclosed in U.S. Pat. No. 5,400,722 where the primary purpose of the device is to determine whether persons passing from one zone to another are supposed to be there. That device includes scales to weigh the person and card authenticating equipment. All of these patented devices are unlike the present invention because they do not concentrate the effort of the invention on protection of the customer. It will be seen that the present invention does not concern itself with a transaction interface, but primarily is involved with securing the person of the customer immediately before, during and after the transaction.

DETAILED DESCRIPTION

Figure 1:
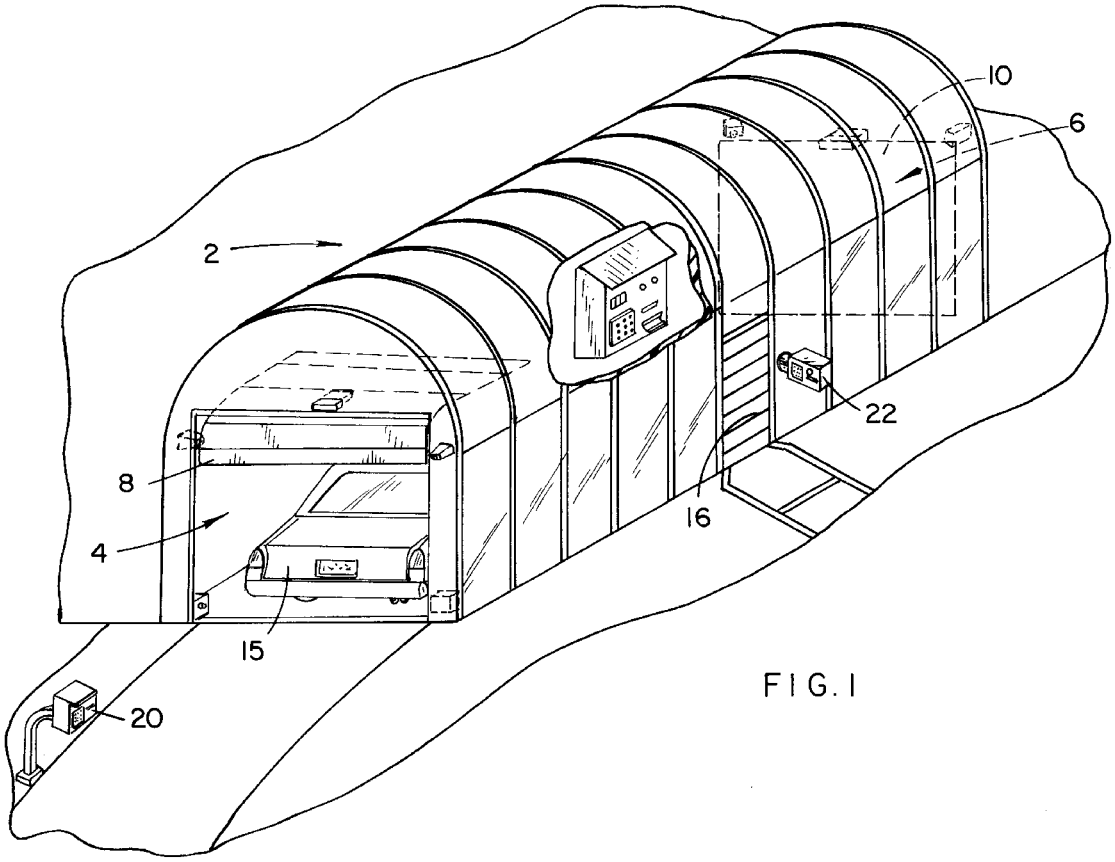
FIG. 1 is a perspective view of an enclosure according to the present invention, with a portion cut away to show the transaction device, such as an automated teller machine.
Figure 2:
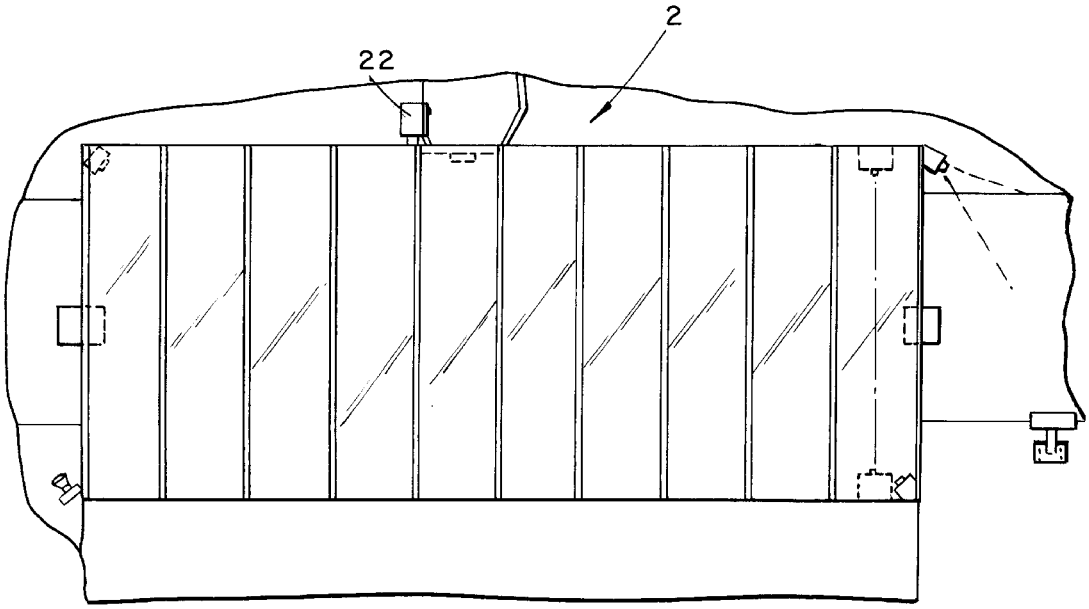
FIG. 2 is a top view of the transaction enclosure.
Figure 3:
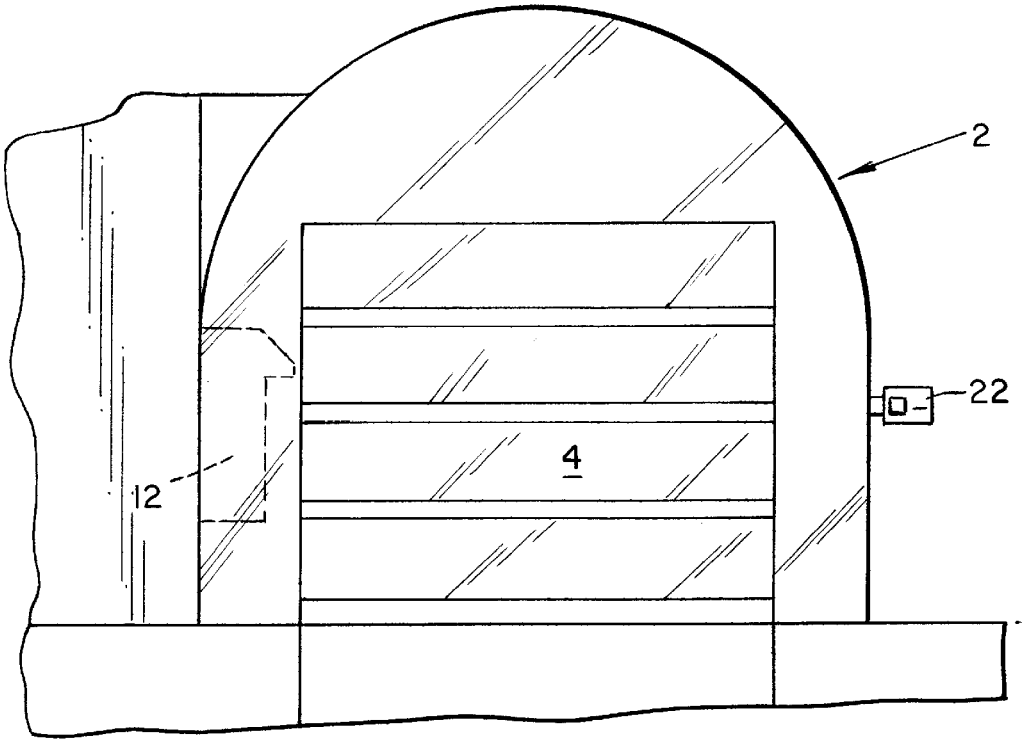
FIG. 3 is an end view of the enclosure, showing the entry door, or the ingress port.
Figure 4:
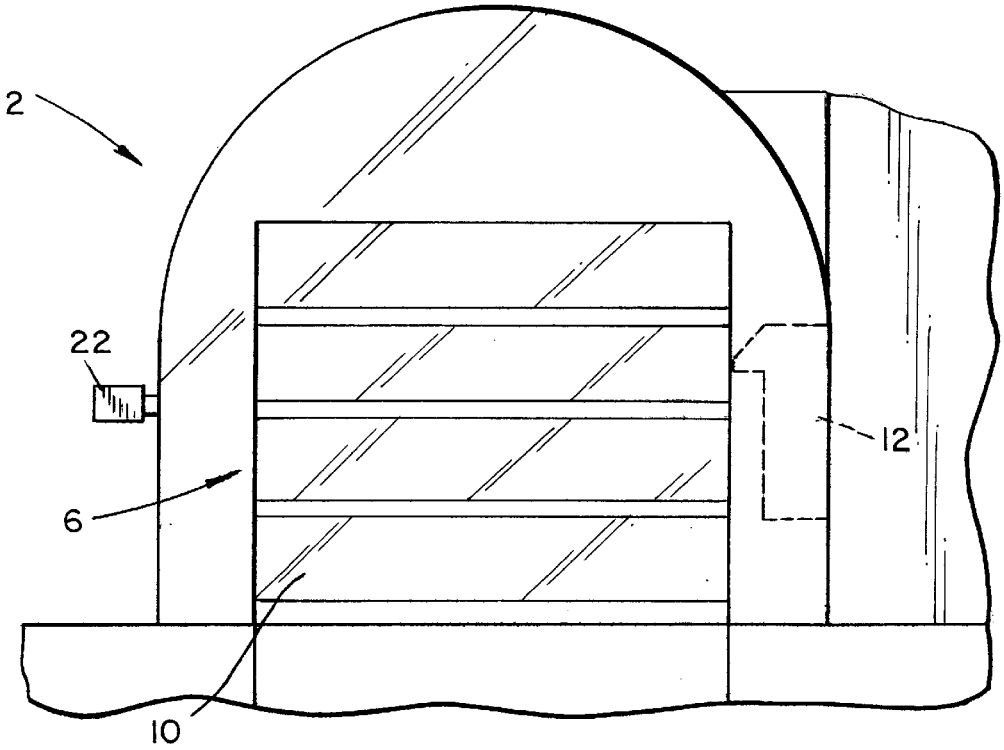
FIG. 4 is an end view of the enclosure, showing the exit door, or the egress port.

The transaction enclosure 2 of the present invention is preferably one which can accommodate both vehicular and pedestrian traffic. Accordingly, the enclosure may be any one of many different designs which will allow a vehicle to enter at one end of the structure and directly exit from the opposite end, similar to a car wash. Ingress and egress to the enclosure is provided respectively by an entry port 4 and an exit port 6. Each of these ports is equipped with overhead doors 8 and 10 which are electrically operated in a well known manner. Inside the enclosure 2 and mounted on the wall thereof is an automated teller machine 12, which can be easily accessed by the driver of a vehicle 15 after entering the enclosure.

Aside from the wide choice of structural designs, the enclosure is preferably constructed of thickly layered Plexiglas. The layers of Plexiglas are cemented together by a semi-transparent epoxy sealer which has several functions, in addition to that of acting as a cement. The epoxy layer adds to the strength and bullet resistant properties of the Plexiglas while at the same tine distorting the light transfer through the enclosure to the point of allowing persons and vehicles to be indistinctly seen through the walls of the enclosure, but obscuring observation from outside the enclosure of the details of any transaction taking place inside the enclosure, such as the numbers keyed into the teller machine or the amount of money being received by a customer.

Preferably, but not necessarily, included in the enclosure is a side entrance 16 for pedestrian traffic. This entrance 16 is equipped with a traditional type of normally locked security door whose opening is controlled by apparatus to be described.

Access to the interior of the enclosure 2 is obtained by a customer who employs an appropriate entry key in an accommodating terminal such as, for example, keying in a recognized code, or inserting into a terminal slot, the familiar ATM/credit card. The entry key may be applied to either one of two terminals 20 and 22, positioned respectively at the side of the vehicle driveway 24 and the walk up entrance 26. Depending on the design choice, activation of the opening sequence by the entry key into terminal 20 may trigger the door to open directly, or alternatively, the entry key may merely arm the opening system which is subsequently put into operation by apparatus sensing the location of the vehicle with respect to the enclosure. Detectors which can activate a door opening motor are well known and include such devices as a micro-wave proximity detector or a photo-electric beam which is interrupted by the presence of a vehicle at a selected point in front of the ingress port. Disclosure of the electronic details of the devices discussed herein is not necessary since one of the objects of the invention is to use state of the art electronic hardware to accomplish the functions which are described.

Opening of the pedestrian entry way is accomplished in the same manner as that for the vehicular port, except that since the pedestrian terminal is located close to the pedestrian door, it is preferable to activate the door opening mechanism directly when the entry key is properly applied to the pedestrian terminal 22.

When the pedestrian customer is safely inside the enclosure and the customer allows the door to close, the door becomes locked and an accessory lock-out circuit disables the opening mechanism for both the pedestrian and the vehicular entries so that entry by another person into the enclosure is not possible while one customer is within the enclosure. The same operation takes place with respect to the vehicular entrance. Once the vehicle has entered the enclosure and the rear end of the vehicle has cleared the plane of the ingress port door, a photo-electric beam operated device detects the passing of the vehicle and initiates the door closing operation. Similar to the closing operation of the pedestrian door, when the vehicular door is closed by the photo-electric beam device, the opening mechanism for both the vehicular and pedestrian entrances is disabled.

After the customer has completed the transaction within the enclosure, the appropriate door may be opened to allow egress from the facility. In the case of the pedestrian, several options are available. The simplest device is one permitting the customer to manually open the door in a manner well know for doors which are locked from one side but may be freely opened from the other. For handicapped or elderly patrons, however, it may be preferable to equip the door with an electric opener which may by activated by the customer from a switch on the inside of the enclosure. In either case, when the door is opened from inside the enclosure and then closed again, the lock-out mode is over-ridden and the door opening mechanisms are once again enabled in order to serve the next customer.

Design choices are also available for opening the vehicular exit door. One choice is to provide a push button type of switch on or near the automatic teller machine which can be activated by the customer in the vehicle to open the door. A second choice is to provide an automatic device similar to the one described for opening the entry door, that is, a detector which senses the position of the vehicle and opens the door in response thereto. After the vehicle passes through the plane of the exit door a sensor similar to the door closing detector at the entry door, will detect the position of the vehicle as being outside the enclosure and will active the exit door motor to close the exit door. Upon closing of the vehicular exit door, as described, the lock-out mechanism will again be overridden and the door opening means will be enabled to provide service to the next customer.

The combination of devices already described will afford complete security within the confines of a protected enclosure for a person transacting business which might otherwise be subject to criminal intrusion. The basic elements of the inventive combination may be enhanced, however, by a number of additional features. Video cameras may be positioned at the entrances of the facility to monitor activity at these locations. These cameras could, of course, be continuous in their operation, or they could be activated by the use of the entry key in either of the terminals, or by the mere approach of a person or vehicle to the entry ports.

While employing the combination of elements, as described above, to implement a secure transaction environment, it is possible that proper entry could be made to the enclosure by one possessing the required entry key and that a second person with criminal intent could remain within the enclosure, waiting for the next customer. To prevent such an occurrence, a sound wave sampler, or motion detector, is installed within the enclosure. The motion detector is turned on at such times as the entry opening mechanisms are enabled. If motion or activity is detected within the enclosure, the lock-out devices are immediately activated, preventing a customer from entering into a potentially dangerous situation. At the same time appropriate alarms can be activated to alert appropriate officials to investigate and to remove the intruder.

I claim:

1. A transaction security system for housing both vehicular and pedestrian traffic, comprising, an enclosure sized and adapted to receive an automotive vehicle, aligned ports in the enclosure for vehicular ingress and egress, door means for each of said ports, first opening means operably connected to the ingress door means and having a control terminal disposed exteriorly of the enclosure for opening the ingress port, first closing means operably connected to the ingress door means and responsive to a selected position of a vehicle inside the enclosure, for closing the ingress port, lock-out means connected to the opening means and responsive to the operation of the first closing means to disable the first opening means, second opening means operably connected to the egress port door means, second closing means operably connected to the egress port door means and responsive to a selected position of a vehicle outside of the enclosure to close the egress port after a vehicle leaves the enclosure, and enabling means responsive to operation of the second closing means to overcome the lock-out means and enable the first opening means.

2. The combination of claim 1 and further comprising, a pedestrian port in said enclosure having door means, third opening means operably connected to the pedestrian port door means and having a control terminal disposed exteriorly of the enclosure for opening the pedestrian port, third closing means operably connected to the pedestrian port door means and responsive to a selected position of a pedestrian inside the enclosure, for closing the pedestrian port, lock-out means connected to the first and third opening means and responsive to the operation of either the first or third closing means to disable the first and third opening means, third closing means operably connected to the pedestrian port door means to close the egress port, and enabling means responsive to operation of the third closing means to overcome the effect of the lock-out means and enable the first and third opening means.

3. The combination of claim 1 and further comprising motion detector means operatively connected to the lock-out means and disposed interiorly of the enclosure and responsive to movement within the enclosure to disable the first and third opening means.

4. The combination of claim 3 and further including at least one camera means disposed exteriorly of the enclosure and responsive to operation of either the first or third opening means.

* * * * *